US007399926B2

(12) United States Patent
Park et al.

(10) Patent No.: US 7,399,926 B2
(45) Date of Patent: Jul. 15, 2008

(54) COMMUNICATION CABLE HAVING OUTSIDE SPACER AND METHOD FOR PRODUCING THE SAME

(75) Inventors: Chan-Yong Park, Seoul (KR); Gi-Joon Nam, Seoul (KR); Jong-Seb Baeck, Gyeongsangbuk-do (KR); Woo-Yong Dong, Gyeongsangbuk-do (KR)

(73) Assignee: LS Cable Ltd., Seoul (KR)

( * ) Notice: Subject to any disclaimer, the term of this patent is extended or adjusted under 35 U.S.C. 154(b) by 0 days.

(21) Appl. No.: 11/490,990

(22) Filed: Jul. 20, 2006

(65) Prior Publication Data

US 2007/0066124 A1 Mar. 22, 2007

(30) Foreign Application Priority Data

Jul. 28, 2005 (KR) ..... 10-2005-0069096

(51) Int. Cl.
*H01B 11/02* (2006.01)

(52) U.S. Cl. ..... 174/113 R; 174/113 C

(58) Field of Classification Search ..... 174/113 R, 174/113 C

See application file for complete search history.

(56) References Cited

U.S. PATENT DOCUMENTS

| | | | | |
|---|---|---|---|---|
| 3,983,313 | A * | 9/1976 | Ney et al. | 174/121 SR |
| 2005/0006132 | A1 * | 1/2005 | Clark | 174/113 C |
| 2005/0087360 | A1 * | 4/2005 | Speer | 174/113 C |
| 2005/0092515 | A1 * | 5/2005 | Kenny et al. | 174/113 R |
| 2005/0133246 | A1 * | 6/2005 | Parke et al. | 174/113 R |

* cited by examiner

*Primary Examiner*—Chau N Nguyen
(74) *Attorney, Agent, or Firm*—Jones Day

(57) ABSTRACT

A communication cable includes at least one twisted wire pair formed by twisting a plurality of insulation-coated wires; a sheath surrounding the twisted wire pair; and a protrusion formed on an outer surface of the sheath. This communication cable may prevent alien crosstalk particularly at high-speed transmission so that transmission characteristics of the communication cable may be stably kept.

12 Claims, 6 Drawing Sheets

COMMUNICATION CABLE HAVING OUTSIDE SPACER AND METHOD FOR PRODUCING THE SAME

BACKGROUND OF THE INVENTION

1. Field of the Invention

The present invention relates to a communication cable, and more particularly to a communication cable having an improved configuration capable of high-speed transmission by restraining an alien crosstalk phenomenon between cables.

2. Description of the Related Art

Generally, a so-called UTP (Unshielded Twisted Pair) cable is widely used as a communication cable. For making the UTP cable, wires composed of a conductor made of copper or the like and a coating for insulating the conductor are twisted to make a wire pair (see FIG. 1), and about four wire pairs are collected and the coated.

Such a communication cable is classified using an identifying symbol, named Category (or, Cat.) depending on its signal transmission capability. For example, Cat.3 enables 16 MHz signal transmission, Cat.4 enables 20 MHz signal transmission, and Cat.5 enables 100 MHz signal transmission. As a higher modulating frequency is used, a greater amount of information may be transmitted. However, as a higher modulating frequency is used, crosstalk in a cable and crosstalk between cables are generated, which makes it difficult to separate signals at a receiver. Due to the reason, information transmission capability of the UTP cable has been limited to the level of about 155 Mbps (Megabit per sec).

However, along with the development of transmission equipment technique, signal degradation caused by crosstalk in a cable can be compensated by means of a compensation or cancellation method using DSP (Digital Signal Processing) or the like. Thus, Cat.5e cable may allow 1000 Mbps (or, 1 Gbps) transmission, and IEEE (Institute of Electrical and Electronics Engineers) Standards Committee has formally standardized 1000 Base-T as an Ethernet standard in 1999.

Accordingly, a high frequency is much more used for increase of transmission capability. However, as a higher frequency is used, insertion loss and crosstalk between wires around a cable are much increased in proportion thereto. Furthermore, recently, there have been attempts to use a high frequency band over 400 MHz, particularly in the range of 500 to 650 MHz, so as to obtain a Shannon capacity of 20 Gbps or above in theory, and actually up to 10 Gbps. In this case, alien crosstalk between cables becomes a vital issue.

In order to overcome the difficulty on signal separation caused by the crosstalk, a compensation equipment such as DSP and a shielded cable having an improved cable structure were conventionally used. First, in case a compensation equipment such as DSP is used, crosstalk generated in a cable may be solved, but alien crosstalk is generated, so transmission signals of adjacent cables are interfered with each other due to the effect of electromagnetic wave according to high frequency transmission, thereby making signal separation impossible.

Meanwhile, the shielded cable is basically designed for usage under poor environments, namely in a place seriously influenced by electromagnetic wave. Such a shielded cable is configured in a way that a metal film having excellent electromagnetic wave shielding characteristic is inserted therein, so that a signal to be transmitted is less influenced by crosstalk caused by electromagnetic wave even in a place where signal crosstalk is serious. FTP (Foiled Twisted Pair) cable and STP (Shielded Twisted Pair) cable are used as the shielded cable.

STP is configured so that pair and sheath are respectively shielded using an aluminum film, and FTP is configured so that only sheath is shielded. In case of having an electromagnetic wave shielding characteristic by means of winding of a metal film, the cable does not cause alien crosstalk by electromagnetic wave during high frequency transmission in the range of 500 to 650 MHz, so it may allow 10 Gbps transmission in a technical aspect. However, there are following problems in replacing an existing UTP cable with FTP cable or STP cable.

First, in Europe, at least 95% of subscriber networks employ UTP cable, and STP cable is used for special purpose. Since at least 95% of relevant industries and engineers possess or study UTP cable network technique, so they have no choice but to prefer UTP cable. In addition, since STP cable has low tolerance in installation, its characteristics are seriously changed depending on installation skill of engineers and the characteristics of the system itself are seriously deteriorated even by a minute carelessness, which makes STP cable not agreeable to general users.

In addition, seeing other drawbacks related to replacement difficulty, in case a metal film is used for shielding like FTP structure, there are problems of an increased density causing increase of weight, bad flexibility, easy corrosion, and difficult processing. In addition, separate processes should be inconveniently added during cable production.

SUMMARY OF THE INVENTION

The present invention is designed to solve the problems of the prior art, and therefore it is an object of the present invention to provide a cable capable of restraining alien crosstalk between cables with a similar structure to a convention UTP cable, but not including a separate shield such as a metal film.

In order to accomplish the above object, the present invention provides a communication cable capable of effectively preventing alien crosstalk by forming a protruded structure (or, an outside spacer) on an outer surface of the communication cable so as to enable high-speed signal transmission.

That is to say, in one aspect of the present invention, there is provided a communication cable, which includes at least one twisted wire pair formed by twisting a plurality of insulation-coated wires; a sheath surrounding the twisted wire pair; and a protrusion formed on an outer surface of the sheath.

Here, it is preferred that there are provided four twisted wire pairs, and each twisted wire pair is configured in a pair shape in which a pair of wires are twisted.

In addition, the protrusion preferably has a spiral structure having at least one ply along a length direction of the sheath, and the spiral structure of the protrusion preferably has a rotating pitch of 30 mm to 120 mm.

In another embodiment of the present invention, the protrusion may have a waved structure having at least one ply along a length direction of the sheath.

In addition, the sheath preferably has a thickness of 0.5 mm to 1.5 mm.

Preferably, the protrusion has a protruded height of 1.0 mm to 3.0 mm, the protrusion has a cross section with a shape selected from the group consisting of circle, triangle, rectangle, trapezoid and semicircle, and the protrusion includes a center portion made of flame-retardant polymer material or metal material; and a polymer material surrounding the center portion.

Preferably, a contact surface between the protrusion and the sheath has a width of 0.2 to 3.0 mm.

In addition, the protrusion preferably has a Young's modulus of 5 to 500 kgf/mm$^2$ with an elongation of 1% or less.

Preferably, the twisted wires in the twisted wire pair has a pitch of 7.0 to 30 mm, there are provided at least two twisted wire pairs, and the wires in the twisted wire pairs are twisted with different pitches from each other.

In addition, preferably, there are provided at least two twisted wire pair, and the communication cable further includes an inside spacer positioned inside the sheath to separate the at least two twisted wire pairs from each other.

In another aspect of the present invention, there is also provided a method for producing a communication cable, which includes (a) forming at least one twisted wire pair by twisting a plurality of insulation-coated wires; and (b) forming an outer coating of the at least one twisted wire pair by extruding the at least one twisted wire pair through a dies having a concave portion of a predetermined shape, and also integrally forming a protrusion on the outer coating in correspondence to the concave portion.

Here, in the step (b), the outer coating is formed with rotating the dies in one direction so that the protrusion is formed in a spiral shape.

In addition, the concave portion preferably has a cross section selected from the group consisting of circle, triangle, rectangle, trapezoid, and semicircle.

In another embodiment, in the step (b), the dies has a plurality of concave portions, and the dies is alternately rotated clockwise and counterclockwise within a predetermined range so that a plurality of waved protrusions are formed on the outer coating.

In still another aspect of the present invention, there is also provided a method for producing a communication cable, which includes (a) forming at least one twisted wire pair by twisting a plurality of insulation-coated wires; (b) forming a sheath coated on the at least one twisted wire pair; and (c) preparing a protrusion having a wire shape and then attaching the protrusion to the sheath.

Here, in the step (c), the protrusion is attached to the sheath with rotating the sheath in one direction so that the protrusion is formed in a spiral shape.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
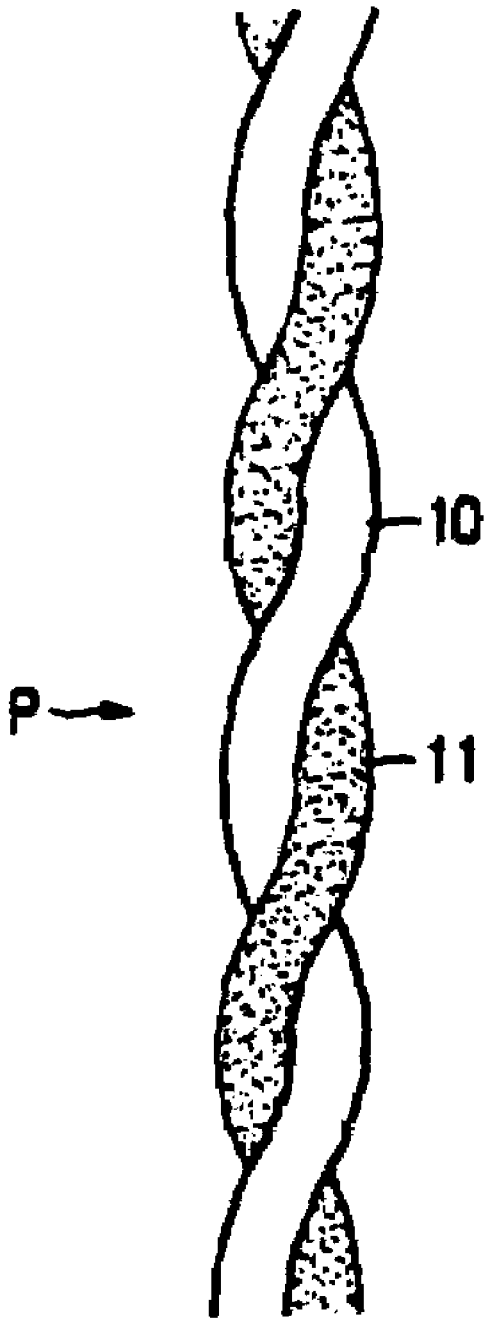
FIG. 1 (PRIOR ART)
FIG. 1 is a perspective view showing a common wire pair provided in a communication cable.
Figure 2:
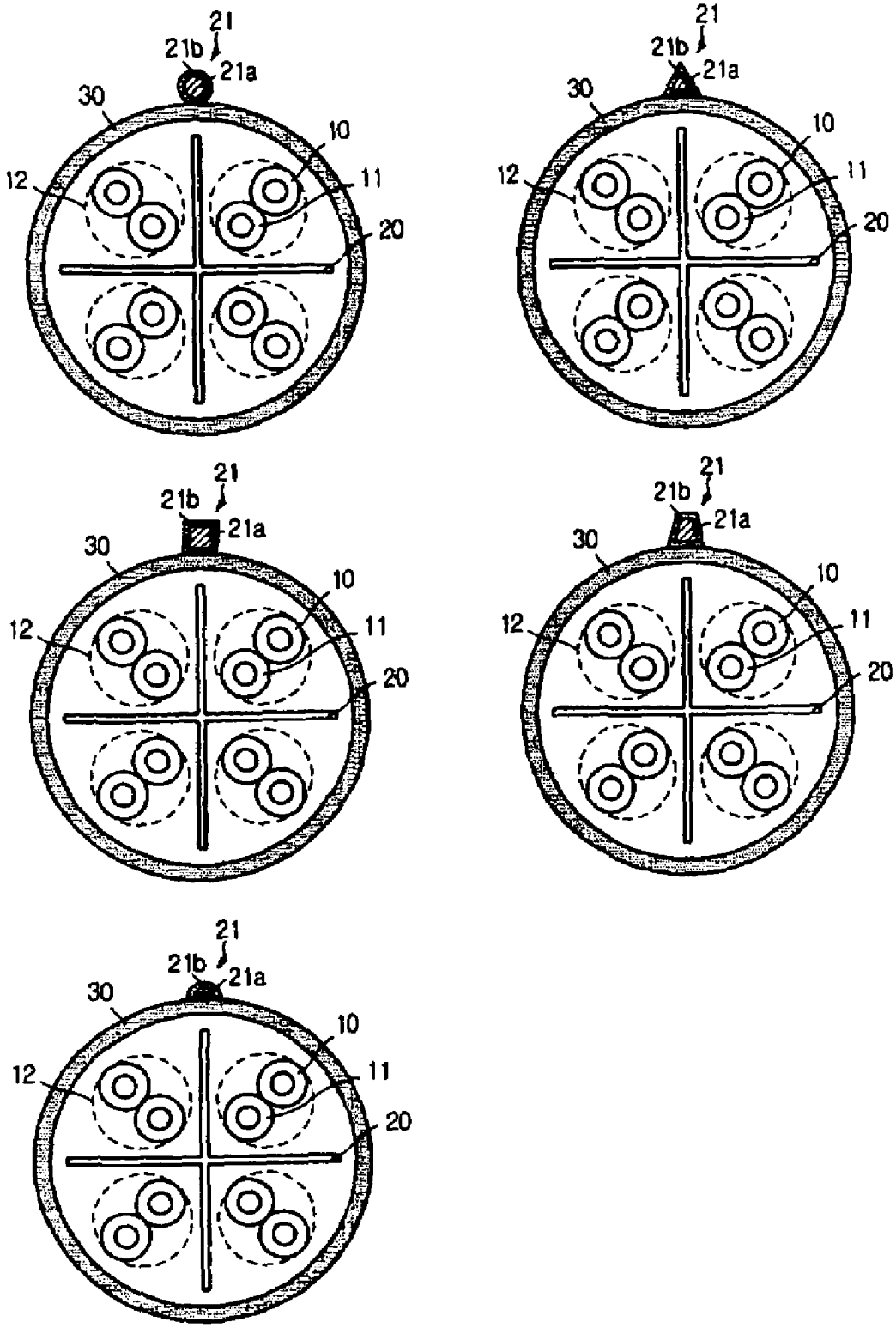
FIG. 2 is a sectional view showing a configuration a communication cable having an outside spacer according to one embodiment of the present invention.
Figure 3:
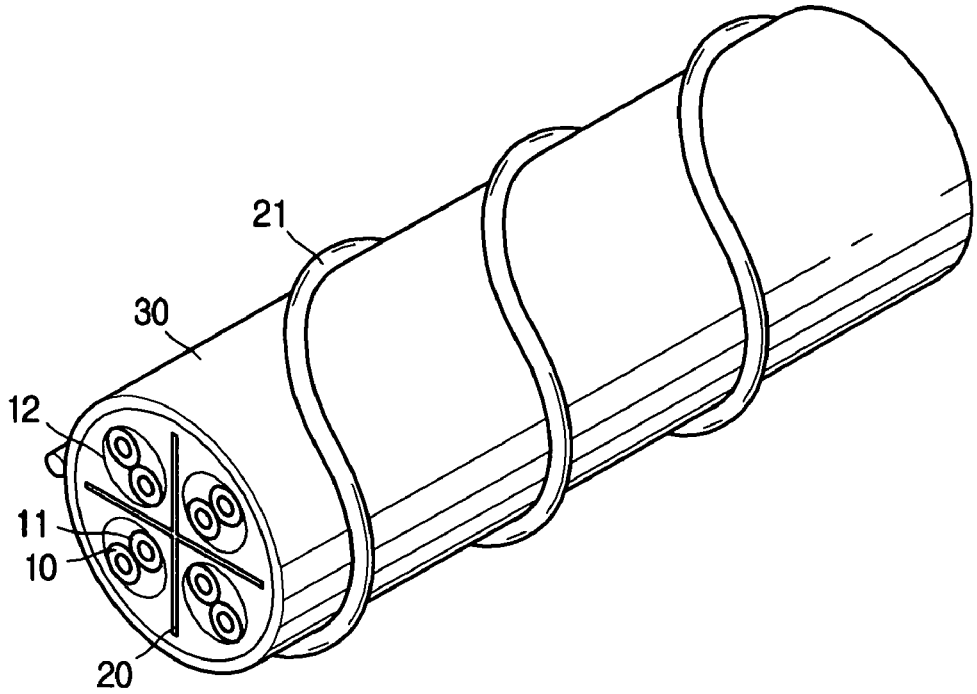
FIG. 3 is a perspective view showing an appearance of the communication cable having an outside spacer according to one embodiment of the present invention.

FIG. 2 is a cross-sectional view showing a configuration of a communication cable having a protrusion of a spiral shape according to one embodiment of the present invention, and FIG. 3 is a perspective view showing an appearance of the communication cable having a spiral protrusion according to one embodiment of the present invention.

Referring to FIGS. 2 and 3, the communication cable having an outside spacer according to one embodiment of the present invention includes a twisted wire pair 12, a cross filler (or, an inner spacer) 20, a sheath 30, and a protrusion (or, an outer spacer) 21.

The twisted wire pair 12 has a pair of insulation-coated wires 10, 11, and it is configured so that two wires 10, 11 forming a wire pair P are twisted with each other. The wire pair P is preferably twisted with a pitch in the range of 7.0 to 30 mm, more preferably 8.0 to 18 mm. If the pitch is shorter than 7.0 mm, consumption of material is increased. If the pitch is longer than 30 mm, the wire pair is structurally not stable and thus does not keep its shape. In addition, though it is illustrated in the drawings that the twisted wire pair 12 has two wires 10, 11, the present invention is not limited thereto, and the twisted wire pair may have more wires. Furthermore, the twisted wire pair 12 may have a coating formed on the outside of the twisted wires 10, 11.

The sheath 30 is made of polyethylene, PVC (Polyvinyl Chloride), or olefin polymer material, and it is configured to surround an aggregation including a plurality of twisted wire pairs 12. The sheath 30 preferably has a thickness of 0.3 to 1.5 mm. In addition, though it is illustrated in the drawings that four twisted wire pairs 12 are included in the sheath 30, the present invention is not limited thereto, and the number of twisted wire pairs may be changed in various ways. In case a plurality of twisted wire pairs 12 having twisted wires have the identical or similar inner pitch condition, crosstalk is easily generated between the wire pairs in the cable, so they are designed to have different pitches. At this time, a pitch difference between adjacent wire pairs is preferably kept over 0.2 mm so as to prevent electromagnetic interactions.

The cross filler 20 is positioned inside the sheath 30. The cross filler 20 isolates four twisted wire pairs 12 from each other to prevent internal crosstalk between the wire pairs P, and also keeps the shape of the cable as it is. The cross filler 20 may be made of PVC or metal film.

The protrusion 21 is used for separation from an adjacent cable by a certain distance. The protrusion 21 is formed on or attached to an outer surface of the sheath 30. The protrusion 21 is made of polymer material 21*b*, and flame-retardant polymer material or metal material 21*a* may be added in its center portion so as to keep its shape. In addition, though it is illustrated in some of the drawings that the protrusion 21 has a circular cross section, the present invention is not limited thereto, and the cross section of the protrusion 21 may be modified into triangle, rectangle, trapezoid, or semicircle, as shown in FIG. 2. The protrusion 21 preferably has a thickness (or diameter) of 1.0 to 3.0 mm, more preferably 1.5 to 2.5 mm, so as to space adjacent cables apart from each other. Here, if the thickness/diameter of the protrusion 21 is not greater than 1.0 mm, a spacing distance is not sufficient and thus crosstalk is generated between cables. If the thickness/diameter of the protrusion 21 is not less than 3.0 mm, a spacing distance is sufficient but too much material is consumed. In addition, the protrusion 21 should keep a certain space though cables are bound in a bundle. Thus, the protrusion 21 preferably has a Young's modulus of 5 to 500 kgf/mm$^2$ with an elongation of 1% or less. If the Young's modulus is less than 5 kgf/mm$^2$, the material of the protrusion 21 becomes too soft to keep an optimal space when cables are bound in a bundle. If the Young's modulus is greater than 500 kgf/mm$^2$, the material of the protrusion 21 becomes too hard to bend or install a cable.

As shown in FIG. 3, the protrusion 21 is attached to the outer surface of the sheath 30 so that it is spirally wound around the outer surface of the sheath 30. Since the protrusion 21 is formed in a spiral shape, it is possible to ensure a spacing distance between adjacent cables. A rotating pitch of the spiral shape is preferably 30 to 120 mm, more preferably 50 to 80 mm. At this time, the rotating pitch of the spiral protrusion 21 is a vital factor in keeping a spacing distance between adjacent cables. If the pitch is greater than 120 mm, an interval between pitches is increased and thus adjacent cables become closer to each other, which easily causes alien crosstalk. If the pitch is smaller than 30 mm, a spacing distance is well kept, but too much material is consumed and weight of the cable is increased.

In addition, a contact surface between the protrusion 21 and the sheath 30 preferably has a width of 0.2 to 3.0 mm. If the contact surface has a width less than 0.2 mm, an adhering force is weak, so the protrusion 21 may be deviated when the cable is bent or contacted with an adjacent cable, thereby not preventing alien crosstalk.

Figure 4:
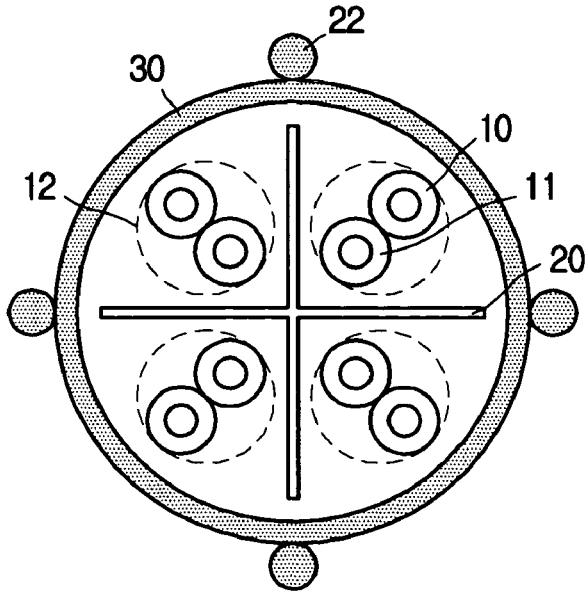
FIG. 4 is a sectional view showing a communication cable having an outside spacer according to another embodiment of the present invention.
Figure 5:
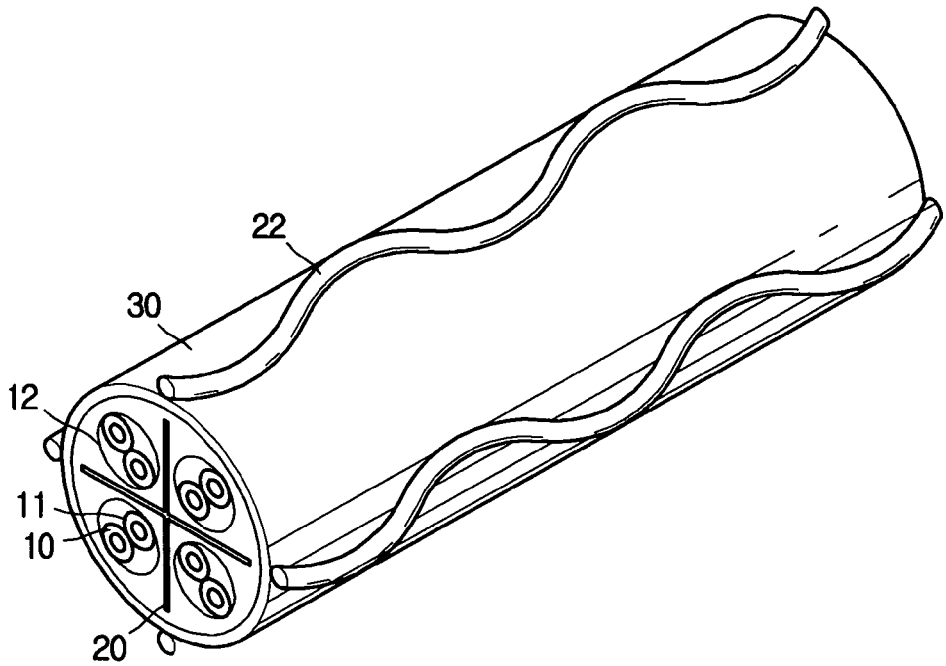
FIG. 5 is a perspective view showing an appearance of the communication cable having an outside spacer according to another embodiment of the present invention.

FIG. 4 is a cross-sectional view showing a communication cable having a protrusion of a waved structure according to another embodiment of the present invention, and FIG. 5 is a perspective view showing the communication cable having a waved protrusion according to another embodiment of the present invention.

The communication cable having a waved protrusion according to this embodiment will be described based on the differences from the above communication cable of the former embodiment.

Referring to FIGS. 4 and 5, the communication cable of this embodiment includes a twisted wire pair 12, a cross filler 20, a sheath 30 and a protrusion 22, similar to the communication cable of the former embodiment, but the protrusion 22 does not have a spiral shape but has a waved shape and is attached to the outer surface of the sheath 30 along a length direction of the sheath 30.

Meanwhile, the protrusion of the present invention is not limited to the spiral shape or the waved shape, but may be modified into various shapes such as a spiral shape having multi plies, a zigzag shape, an embossed shape and a plural ring shape.

Subsequently, a method for producing a communication cable having an outside spacer according to the present invention will be described in detail.

First, a twisted wire pair is prepared by twisting a pair of insulation-coated wires. Four twisted wire pairs are arranged and elongated with facing each other to form an aggregation. Then, an additive is added to a flame-retardant PVC compound to show a stable processing property, and this compound is extruded together with the aggregation to be coated on the outer surface of the aggregation. Such an UTP cable producing method is already well known in the art, and not described here. After that, a wire made of PVC material with a diameter of about 2 mm and also including a copper wire having a diameter of about 1 mm therein is prepared as a protrusion. The wire is mounted to a winder so that the wire will be longitudinally wound in a spiral shape around the UTP cable prepared as mentioned above. During the rewinding process for unwinding and then winding again the prepared UTP cable, the wire is longitudinally wound around the UTP cable by means of the winder, and then the wire is adhered to the UTP cable by an adhesive so that the wire longitudinally wound around the UTP cable is not separated therefrom.

Figure 6:
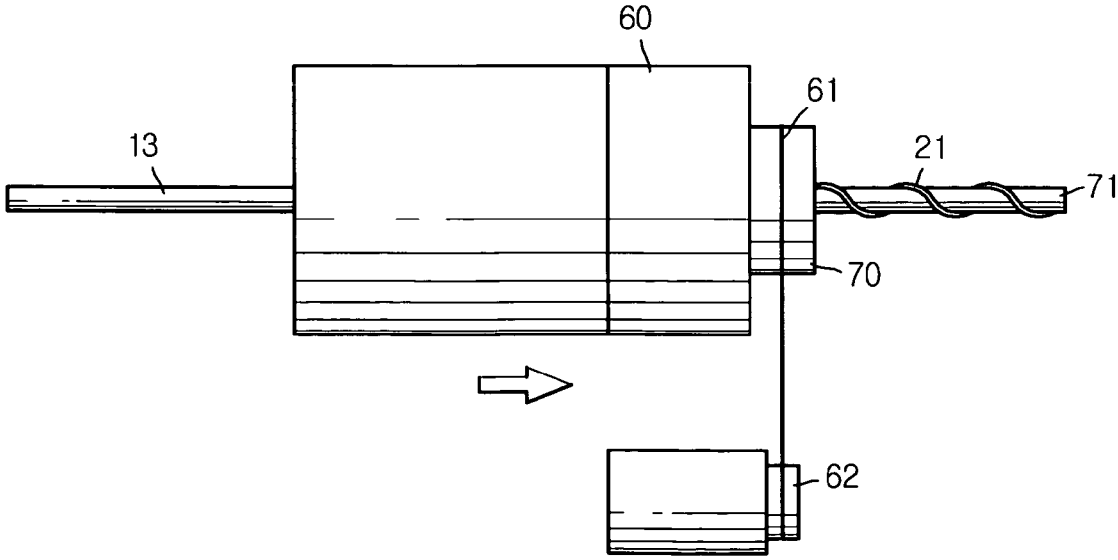
FIG. 6 is a perspective view showing an apparatus for producing the communication cable having an outside spacer according to one embodiment of the present invention.
Figure 7:
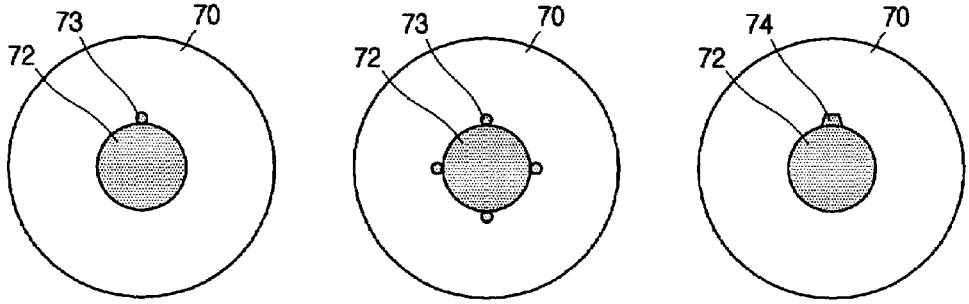
FIG. 7 is a sectional view showing a cross section of a dies of FIG. 6.

Subsequently, a method for producing a communication cable according to another embodiment of the present invention will be described in detail with reference to FIGS. 6 and 7.

First, a twisted wire pair is prepared by twisting a pair of insulation-coated wires. Then, four twisted wire pairs are arranged and elongated with facing each other to form an aggregation 13. A coating material is prepared by adding an additive to LSZH (Low Smoke Zero Halogen), which is a flame-retardant polymer, so as to show a stable processing property. A dies 70 of an extruder is designed to have a dies hole 72 so that the sheath to be coated has a thickness of about 0.8 mm, and also a concave portion is additionally designed in the dies hole 72 in correspondence to a protrusion. For example, the concave portion of the dies 70 may have a circular shape 73, a trapezoidal shape 74, a triangular shape, or a rectangular shape, and there may be provided two or more concave portions. The aggregation 13 and the coating material, prepared as mentioned above, are extruded through the extruder provided with the dies 70 designed as above so that the sheath and the protrusion are integrally formed. During the extruding process, an extruding head 60 and a rotating motor 62 rotatable by a rotating belt 61 are connected to rotate the dies 70. Since the dies 70 is rotated, the protrusion 21 is formed in a spiral shape while the aggregation 13 is coated. At this time, it is possible to change a rotating direction of the rotating motor 62 so that the protrusion may be formed in another shape, for example a waved shape, not in a spiral shape. Since the protrusion is formed together with the coating process as mentioned above to make the communication cable 71 having an outside spacer according to the present invention, it is possible to reduce process number and time for manufacture.

Figure 8:
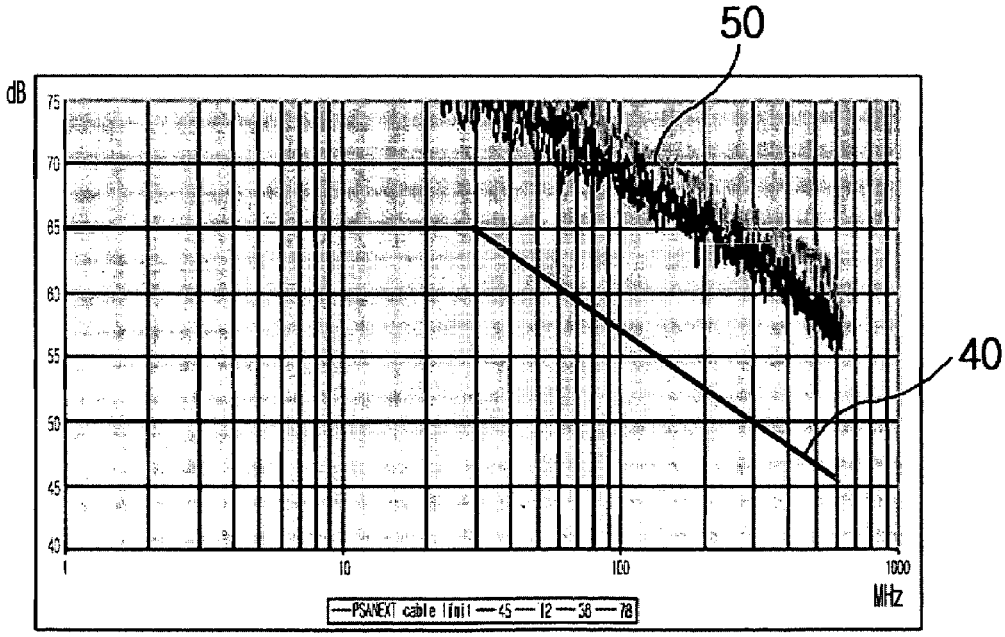
FIG. 8 is a graph showing an alien crosstalk characteristic of the communication cable having an outside spacer according to a preferred embodiment of the present invention.
Figure 9:
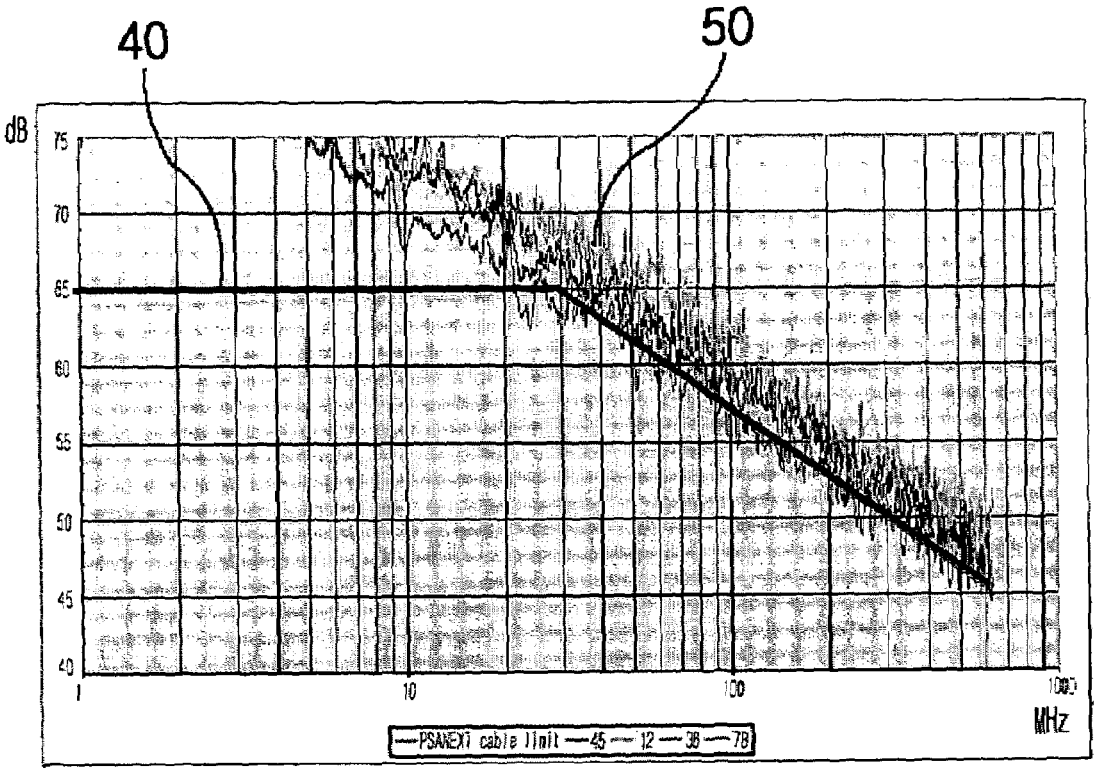
FIG. 9 is a graph showing an alien crosstalk characteristic of a conventional UTP cable.

FIG. 8 is a graph showing an align crosstalk characteristic of the communication cable according to a preferred embodiment of the present invention, and FIG. 9 is a graph showing an align crosstalk characteristic of a conventional UTP cable.

Now, the present invention will be described in more detail with reference to FIGS. 8 and 9 together with a following comparative example.

COMPARATIVE EXAMPLE

It was checked whether a Cat.6 product, which keeps the most excellent transmission rate among conventional UTP cables, is capable of transmitting a signal in the frequency range of 500 to 650 MHz, which is required for high-speed signal transmission over 10 Gbps. For this purpose, a transmission characteristic of a cable was measured using an experiment for a 1+6 structure in which one cable is put in the center and six cables surround the center cable according to the standard specified in IEEE 802.3 where the center portion is most influenced by crosstalk. The product used for this measurement has a coating thickness of about 0.6 mm, and its surface keeps a smooth state due to the coating without any structure installed thereto. As a result of measuring transmission characteristics using the cable, the cable passed all tests including fitted impedance, return loss, attenuation, NEXT (Near End CrossTalk), FEXT (Far End CrossTalk), and ELFEXT (Equal Level Far End CrossTalk), but in the experiment of measuring alien crosstalk that is a crosstalk phenomenon between cables, a worst margin was about −9.0 dB, which is much less than a standard criterion.

That is to say, referring to FIG. 9, a standard criterion 40 is drawn using a solid bold line in the center portion of the graph, and it is regulated that alien crosstalk should not go down beyond this line even in the worst case. As a result of alien crosstalk measurement of the conventional UTP cable, the transmission characteristic value 50 goes down beyond the standard criterion 40 in almost every case. It means that the cable is seriously influenced by surrounding cables and high frequency transmission. Thus, it would be understood that the conventional UTP cable is not capable of 10 Gbps transmission.

To the contrary, referring to FIG. 8, as a result of measuring transmission characteristics using the same experiment as the above, it was found that the communication cable having an outside spacer according to the present invention showed a sufficient margin between the transmission characteristic value 50 and the standard criterion 40. In addition, the margin even has a room of at least 7 to 8 dB even in the worst case, so it is expected that the communication cable of the present invention may sufficiently allow 10 Gbps transmission.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

The communication cable having an outside spacer and its producing method according to the present invention, described as above, give the following effects.

First, since a spacing distance between communication cables may be kept constantly by a suitable value, alien crosstalk caused between communication cables may be prevented, so the communication cable of the present invention may be very usefully used for high-speed signal transmission in the level of 10 Gbps.

Second, since a separate shield such as metal film is not used for preventing alien crosstalk, the process number and cost for manufacturing the communication cable may be reduced, and any inconvenience caused by corrosion of the shield or weight increase of the cable may be decreased.

Third, since the communication cable of the present invention has substantially the same structure and form as an UTP cable that is most commonly used in the prior art, existing network equipment and technique as well as existing production equipment and processes may be advantageously used without many changes.

What is claimed is:

1. A communication cable, comprising:

at least one twisted wire pair formed by twisting a plurality of insulation-coated wires;

a sheath surrounding the twisted wire pair; and a protrusion formed on an outer surface of the sheath;

wherein the protrusion has a spiral structure having at least one ply along a length direction of the sheath, and wherein the spiral structure of the protrusion has a rotating pitch of 30 mm to 120 mm.

2. The communication cable according to claim 1, wherein there are provided four twisted wire pairs, and each twisted wire pair is configured in a pair shape in which a pair of wires are twisted.

3. The communication cable according to claim 1, wherein the protrusion has a waved structure having at least one ply along a length direction of the sheath.

4. The communication cable according to claim 1, wherein the sheath has a thickness of 0.5 mm to 1.5 mm.

5. The communication cable according to claim 1, wherein the protrusion has a Young's modulus of 5 to 500 $kgf/mm^2$ with an elongation of 1% or less.

6. The communication cable according to claim 1, wherein a contact surface between the protrusion and the sheath has a width of 0.2 to 3.0 mm.

7. The communication cable according to claim 1, wherein the protrusion has a protruded height of 1.0 mm to 3.0 mm.

8. The communication cable according to claim 1, wherein the protrusion has a cross section with a shape selected from the group consisting of circle, triangle, rectangle, trapezoid and semicircle.

9. The communication cable according to claim 1, wherein the protrusion includes:

a center portion made of flame-retardant polymer material or metal material; and a polymer material surrounding the center portion.

10. The communication cable according to claim 1, wherein the twisted wires in the twisted wire pair has a pitch of 7.0 to 30 mm.

11. The communication cable according to claim 1, wherein there are provided at least two twisted wire pairs, and the wires in the twisted wire pairs are twisted with different pitches from each other.

12. The communication cable according to claim 1, wherein there are provided at least two twisted wire pairs, and wherein the communication cable further comprises an inside spacer positioned inside the sheath to separate the at least two twisted wire pairs from each other.

* * * * *